US008393876B2

(12) United States Patent
Sloteman et al.

(10) Patent No.: US 8,393,876 B2
(45) Date of Patent: Mar. 12, 2013

(54) GAS TOLERANT SUBSEA PUMP

(75) Inventors: Donald P. Sloteman, New Hope, PA (US); Cliff H. Campen, Pittsburgh, PA (US); Eric S. Conaway, Pittsburgh, PA (US)

(73) Assignee: Curtiss-Wright Electro-Mechanical Corp., Cheswick, PA (US)

( * ) Notice: Subject to any disclaimer, the term of this patent is extended or adjusted under 35 U.S.C. 154(b) by 288 days.

(21) Appl. No.: 12/775,247

(22) Filed: May 6, 2010

(65) Prior Publication Data

US 2010/0284829 A1 Nov. 11, 2010

Related U.S. Application Data

(60) Provisional application No. 61/175,978, filed on May 6, 2009.

(51) Int. Cl.
*F04B 23/04* (2006.01)

(52) U.S. Cl. ..... 417/77; 417/313; 417/423.1

(58) Field of Classification Search ..... 417/423.1, 417/366, 0.242, 423.3, 199.1, 313, 77, 84; 415/143; 55/52, 318; 166/105.5; 832/423.1, 832/366, 0.242, 423.3, 199.1; 95/261, 269
See application file for complete search history.

(56) References Cited

U.S. PATENT DOCUMENTS

| | | | | | |
|---|---|---|---|---|---|
| RE30,836 | E | * | 12/1981 | Bunnelle | 96/214 |
| 4,826,398 | A | * | 5/1989 | Gullichsen | 415/143 |
| 4,877,424 | A | * | 10/1989 | Perkola et al. | 95/270 |
| 4,886,530 | A | | 12/1989 | Dussourd | |
| 4,900,433 | A | * | 2/1990 | Dean et al. | 210/170.11 |
| 4,981,413 | A | | 1/1991 | Elonen et al. | |
| 5,207,810 | A | | 5/1993 | Sheth | |
| 5,375,976 | A | | 12/1994 | Arnaudeau | |
| 5,482,117 | A | * | 1/1996 | Kolpak et al. | 166/265 |
| 5,490,562 | A | | 2/1996 | Arnold | |
| 5,526,684 | A | | 6/1996 | Liu et al. | |
| 5,674,057 | A | * | 10/1997 | Guardiani et al. | 417/423.3 |
| 6,412,562 | B1 | * | 7/2002 | Shaw | 166/335 |
| 6,457,950 | B1 | * | 10/2002 | Cooper et al. | 417/366 |
| 6,705,402 | B2 | * | 3/2004 | Proctor | 166/369 |
| 7,241,104 | B2 | * | 7/2007 | Wilson et al. | 415/1 |
| 7,569,097 | B2 | | 8/2009 | Campen | |
| 2002/0187037 | A1 | * | 12/2002 | Lee | 415/1 |
| 2005/0112003 | A1 | | 5/2005 | Jones | |
| 2006/0110245 | A1 | * | 5/2006 | Ashihara et al. | 415/143 |

FOREIGN PATENT DOCUMENTS

WO 2008004883 1/2008

OTHER PUBLICATIONS

International Search Report corresponding to PCT/US2010/033840 dated Jun. 9, 2011.
International Search Report corresponding to International Application PCT/US2010/033840 dated Jul. 19, 2010.

* cited by examiner

*Primary Examiner* — Devon Kramer
*Assistant Examiner* — Yonas s Cherkos
(74) *Attorney, Agent, or Firm* — Reed Smith LLP

(57) ABSTRACT

A combined canned motor-pump operates directly in the process fluid without the need for shaft seals or buffer or lubricating fluids. The pump incorporates an integral gas-separating system that includes gas separating hydraulics and a flow path that returns the gas to the main gas/oil separator. The gas-separating system includes a pump inlet for accepting incoming multiphase flow, at least one blade rotatable about the axis of rotation, an open annulus region for separating gas from liquid in the multiphase flow, at least one radial hole in the shaft for directing separated gas to the axial hole, and a pump outlet for discharging liquid from the pump.

9 Claims, 3 Drawing Sheets

GAS TOLERANT SUBSEA PUMP

CROSS-REFERENCE TO RELATED APPLICATION

This application claims the benefit under 35 U.S.C. §119 (e) of the earlier filing date of U.S. Provisional Application Ser. No. 61/175,978 filed on May 6, 2009, the contents of which are hereby incorporated by reference.

FIELD OF INVENTION

The invention relates generally to a multistage centrifugal pump with a canned motor and a suction gas separation system for multiphase flow handling for use in multiphase flow systems such as subsea separator systems.

BACKGROUND OF THE INVENTION

Subsea multiphase pump technologies are presently in operation at several locations around the world. Two known technologies are helico-axial and twin screw pumps.

Helico-axial pumps are rotordynamic type pumps that have been developed specifically for multiphase pumping, and can handle flows of all-liquid or with high gas volume fraction without a reduction in capacity. A typical helico-axial stage consists of an axial flow impeller of helical blades followed by a diffuser to direct the flow to the next stage. The blade and vane geometries are designed to homogenize the gas-oil mixture to prevent separation while increasing the total pressure of the fluid.

In applications requiring a high pressure rise from the pump, helico-axial stages are typically utilized in a hybrid arrangement prior to centrifugal impeller stages. The pressure rise increase in the helico-axial stages reduces the gas volume of the fluid mixture to a level at which the centrifugal stages will operate adequately, typically less than 51 gas volume fraction. The bulk of the pump pressure rise then occurs in a series of centrifugal stages.

Gas volume reduction in a multiphase flow is essentially a reciprocal function of the pressure ratio referenced to the pump inlet pressure. Doubling the pressure reduces the gas volume by half. Pressure rise across a helico-axial pump stage is a constant differential pressure, typically a maximum of about 7 bar, regardless of inlet pressure. A helico-axial stage with a suction pressure of 7 bar can double the pressure ratio with a 7 bar pressure rise, decreasing the gas volume fraction by 50%. The same stage operating with a suction pressure of 70 bar can create a pressure ratio of 1101 with a 7 bar pressure rise, decreasing the gas volume fraction by 9%. The number of helico-axial stages in a hybrid pump has typically been limited to 7 due to rotordynamic limitations on the shaft length, limiting the maximum pressure rise to approximately 50 bar. This illustrates that the operating principles of helico-axial pumps limit the combination of suction pressure and gas volume fraction at which they can effectively operate. Subsea separators can operate at pressures that are greater than those at which helico-axial pumps can be effective. A helico-axial pump is described in U.S. Pat. No. 5,375,976, the disclosure of which is incorporated by reference herein.

Twin screw pumps are positive displacement type pumps, producing a constant volumetric flow rate in a progressing cavity formed between two interlocking helical screws on parallel shafts. The constant volumetric flow rate is determined by the volume of the cavity between the screws, the screw pitch, and the rotational speed. Tight clearances at the interfaces between the screw interlocking surfaces and between the screw tips and the housing are required to minimize recirculating flow that reduces the volumetric efficiency.

Because of their positive displacement operation, twin screw pumps provide an effective means of multiphase fluid transport. They can handle fluids with gas volume fractions as high as approximately 95% without a reduction in flow rate. For effective operation, a twin screw pump must handle fluids with higher viscosity (>200 cP) to create a seal at the small clearances between the screw surfaces and the housing. Lower viscosity fluids result in greater recirculating leakage flow that reduces the volumetric efficiency. Typically, subsea separators are more effective with low viscosity fluids, preventing the twin screw pump technology from being an attractive pumping option for subsea separation systems. A twin screw pump is described in US 2007/0274842, the disclosure of which is incorporated by reference herein.

A subsea separator is described in U.S. Pat. No. 5,526,684, the disclosure of which is incorporated by reference herein. Gas separator systems are described in U.S. Pat. Nos. 6,705,402; 5,207,810 and 4,886,530, the disclosure of which are incorporated by reference herein. Various types of inducers are shown in U.S. Pat. Nos. 3,339,821; 3,442,220; 6,435,829 and 7,207,767, the disclosures of which are incorporated by reference herein.

SUMMARY OF THE INVENTION

In accordance with an embodiment of the invention, a combined canned motor-pump operates directly in the process fluid without the need for shaft seals or buffer or lubricating fluids. The pump incorporates an integral gas-separating system that includes gas separating hydraulics and a flow path that returns the gas to the main gas/oil separator. The gas-separating system includes a pump inlet for accepting incoming multiphase flow, at least one blade rotatable about the axis of rotation, an open annulus region for separating gas from liquid in the multiphase flow, at least one radial hole in the shaft for directing separated gas to the axial hole, and a pump outlet for discharging liquid from the pump.

The pump with its integral gas separator can operate with high suction gas concentrations while providing the required head rise and flow rate. The pump with its integral gas separator improves the efficiency of the main gas/oil separator in the system by returning the separated portion of the gas carry-under back to the main separator where the gas is more easily kept from returning to the liquid phase. The reduction in gas in the pumped effluent increases flow assurance, reducing the potential for hydrate formation when water is present. Because the pump separator does not have to compress the gas at the pump suction the system can operate over a wider range of separator pressures and resulting pump suction pressures than a hybrid helico-axial/centrifugal pump configuration that must first compress the gas before purely centrifugal stages can be employed. Because the pump does not have to provide specialized high gas-capable (helico-axial) stages the centrifugal impeller stack can be kept to a length that makes achieving the required rotordynamic critical speed practical while including enough centrifugal stages to produce the required pressure rise.

DETAILED DESCRIPTION OF THE INVENTION

Figure 1:
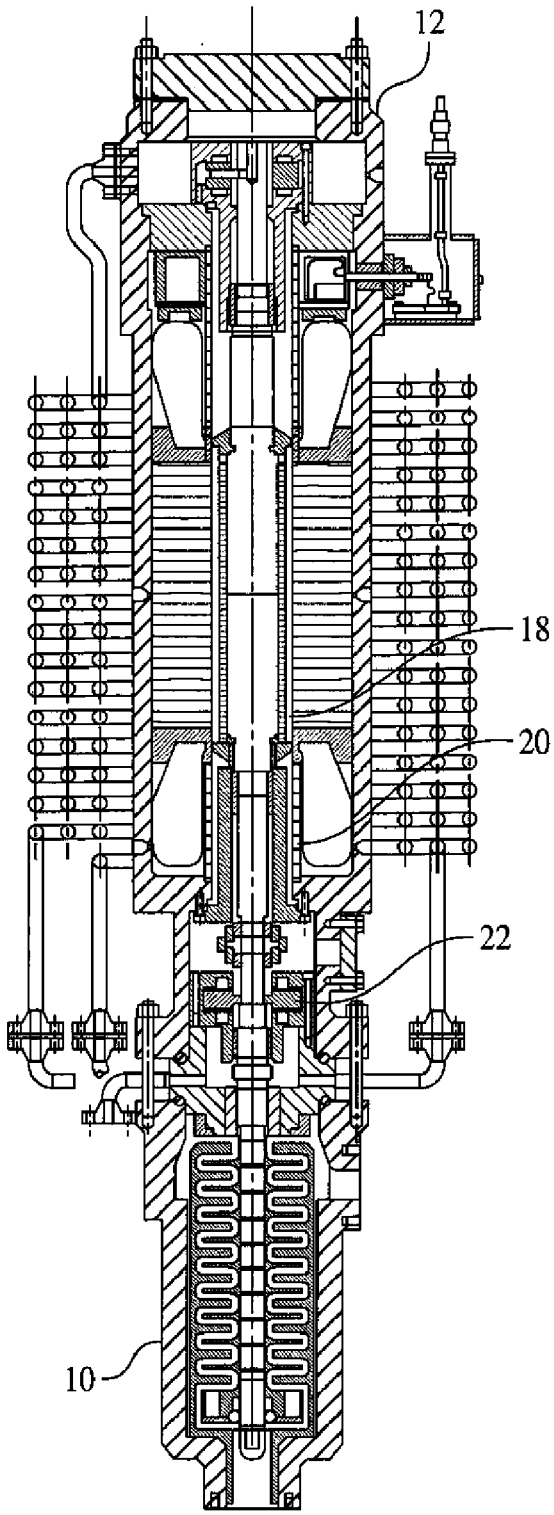
FIG. 1 is a cross-sectional view of a typical multi stage centrifugal pump with canned motor driver, the top vent and suction separator is not shown.

It is to be understood that the FIGS. and descriptions of the invention have been simplified to illustrate elements that are relevant for a clear understanding of the invention, while eliminating, for purposes of clarity, other elements that may be well known. Those of ordinary skill in the art will recognize that, such as, for example, all of the components of the canned motor pumps other than as shown in the FIGS. have not been described in detail herein for the purpose of simplifying the specification of the patent application.

For purposes of the description hereinafter, the terms "upper", "lower", "vertical", "horizontal", "axial", "top", "bottom", "aft", "behind", and derivatives thereof shall relate to the invention, as it is oriented in the drawing FIGS. However, it is to be understood that the invention may assume various alternative configurations except where expressly specified to the contrary. It is also to be understood that the specific elements illustrated in the FIGS. and described in the following specification are simply exemplary embodiments of the invention. Therefore, specific dimensions, orientations and other physical characteristics related to the embodiments disclosed herein are not to be considered limiting.

The detailed description will be provided hereinbelow with reference to the attached drawings. In the drawings, like reference characters designate corresponding parts throughout the views.

Figure 2:
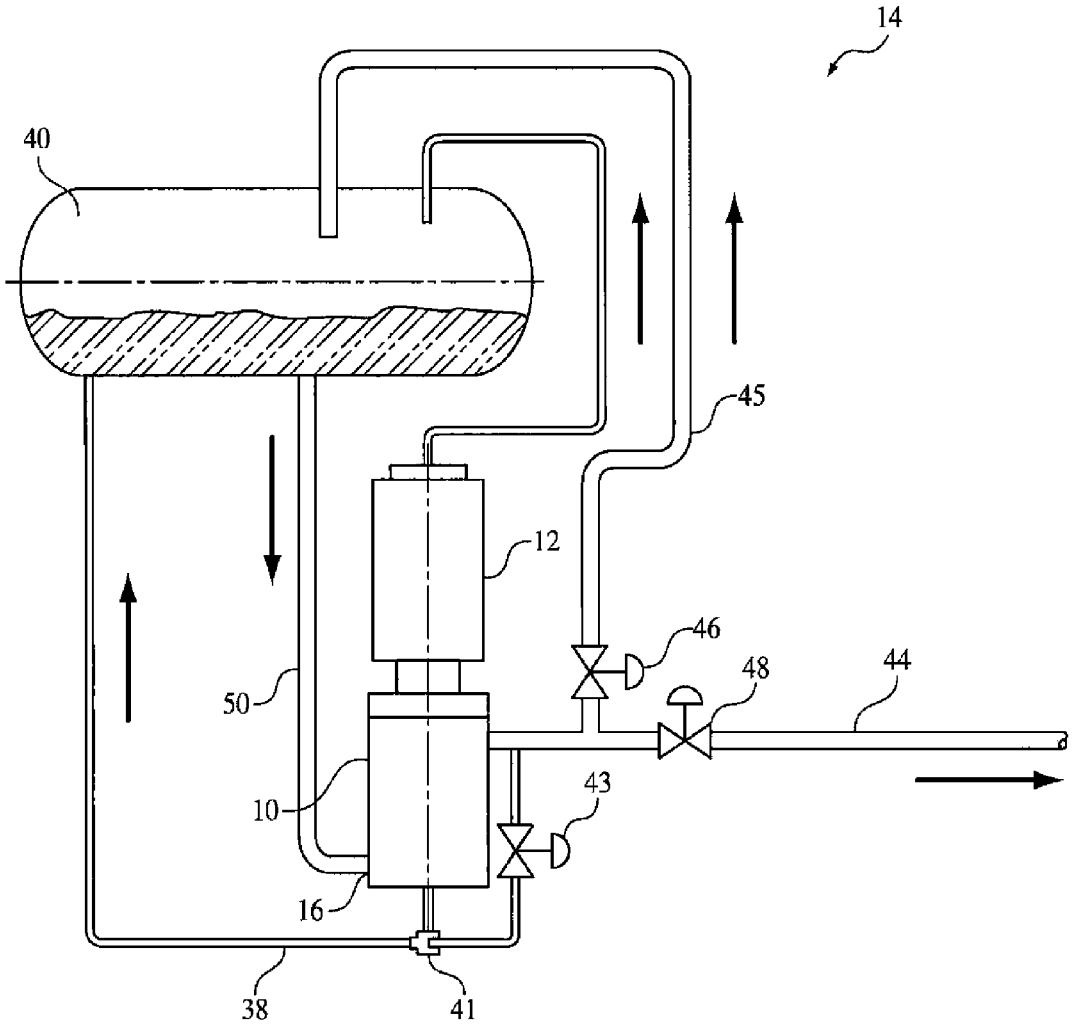
FIG. 2 is a schematic of the suction separator/eductor installation.

A multistage centrifugal (rotordynamic type) pump 10 (FIG. 1) with a canned motor 12 and a suction gas separation system for multiphase flow handling has been conceived for use in subsea separator systems (FIG. 2). A suction gas separation system 14 permits the pump 10 to accommodate a multiphase flow with free gas at its inlet 16 while maintaining pumping capacity through the centrifugal hydraulics. The hermetically sealed metal rotor and stator cans 18, 20 of the motor 12 separate the motor stator insulation and the rotor copper from the process fluids, maintaining motor electrical integrity. The cans 18, 20 allow the pump/motor 10/12 to operate without the need for dynamic shaft seals or a buffer fluid and its required support systems. The pump/motor uses abrasion tolerant hydrodynamic bearings that are lubricated with the process fluid, eliminating the need for a bearing lubrication fluid and its required support systems. This simpler canned pump/motor 10/12 configuration is more robust than present subsea pump configurations because it does not contain the potential failure points of dynamic shaft seals, buffer fluid systems, or bearing lubrication systems. The canned pump/motor 10/12 configuration also allows the pump/motor 10/12 to operate with only electrical power supplied from the topside. This results in low cost subsea umbilical systems and eliminates the ongoing cost of buffer fluid consumption, while placing the fewest demands on the host facility topside support systems.

In embodiments of the invention, the subsea separation system (FIG. 2) transports multiphase fluids from deep offshore wells to a topside platform. Separation at or close to a hydrocarbon well decreases the well head pressure—increasing the well flow. Also, if water is present in the pumped fluid, separating the gas from the liquid reduces the likelihood of hydrate formation in the production flow line and resultant flow line blockage.

Subsea separation provides challenges for the subsea pump due to significant gas carry-under from the separator to the pump. This is because subsea separators are designed to be compact, making them generally less efficient than topside separators of equivalent capacity. The compact design is required to reduce separator weight, since heavy shells are required to resist high subsea pressures. Design of the subsea multiphase pump for subsea separator operation, therefore, must accommodate the gas carry-under inherent in subsea separator design.

The alternative pump arrangement described in this disclosure is applicable to multiphase pumping in applications that are outside the capabilities of the helico-axial or twin screw pump technologies, though it will also be effective in applications for which the two existing technologies presently operate. The subsea multiphase pump combines a canned motor with a novel suction separation system to provide a robust solution to subsea multiphase pump challenges.

The subsea multiphase pump addresses the challenges of multiphase pumping by using the first stage or stages of hydraulics to separate the gas from the liquid (FIGS. 3A and 3B) while allowing the pump to operate with a low Net Positive Suction Head (NPSH) at its inlet. The liquid is passed on to subsequent centrifugal stages in which sufficient pressure is added in the typical manner to transfer the liquid to the topside station. The gas is passed to a separated gas system that returns it to the subsea separator.

In embodiments of the invention, multiphase flow enters at the pump inlet 16. The inlet flow is shown to be radial in FIG. 2, but the inlet flow can also be tangential or axial.

This flow enters the axial hydraulics 24, which are specifically designed to drive gas toward the hub while performing as an inducer to increase the total pressure of the flow before it enters the centrifugal impeller stages. In embodiments of the invention, as shown in FIG. 2, the axial hydraulics are blades 25 rotatable about an axis of rotation 26. The hydraulic stage(s) use special axial or mixed flow blade geometry that is designed to maximize the centrifugal forces that naturally tend to separate the denser liquid from the less dense gas. The denser liquid is driven toward the outer diameter of the rotating blades 25, while the gas migrates toward the inner diameter. The blade shape is tuned to optimize control of the gas and liquid flows to direct them to the appropriate regions. The blade shape also acts as an inducer where appropriate to enable the pump to operate with a low NPSH at its inlet without causing cavitation.

The gas at the hub enters the gas separation feature, which is presently shown as an annulus or annular "scoop" 28. This feature can have a number of geometric variations, including holes, slots, vanes, various curvature or angles, etc. The annulus or scoop 28 is sized such that the separated gas flow path area is, in this embodiment, of the same ratio of the liquid flow path area, as the pumped multiphase liquid gas volume fraction. This can vary as required to make the technology work and may be, for example, 15% of the liquid flow path area, to accommodate 15% gas by volume fraction. The axial spacing between the axial hydraulics 24 and the centrifugal impeller 30 can also vary as required.

The liquid with the gas removed continues downstream to one or more centrifugal impellers 30, where its pressure is increased in the standard way so it can be driven through the pipeline.

Figure 3A:
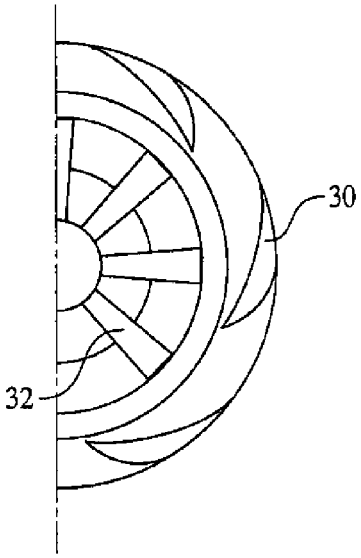
FIGS. 3A and 3B show partial cross-sectional top and side views of a suction separator with gas collection scoop.
Figure 3B:
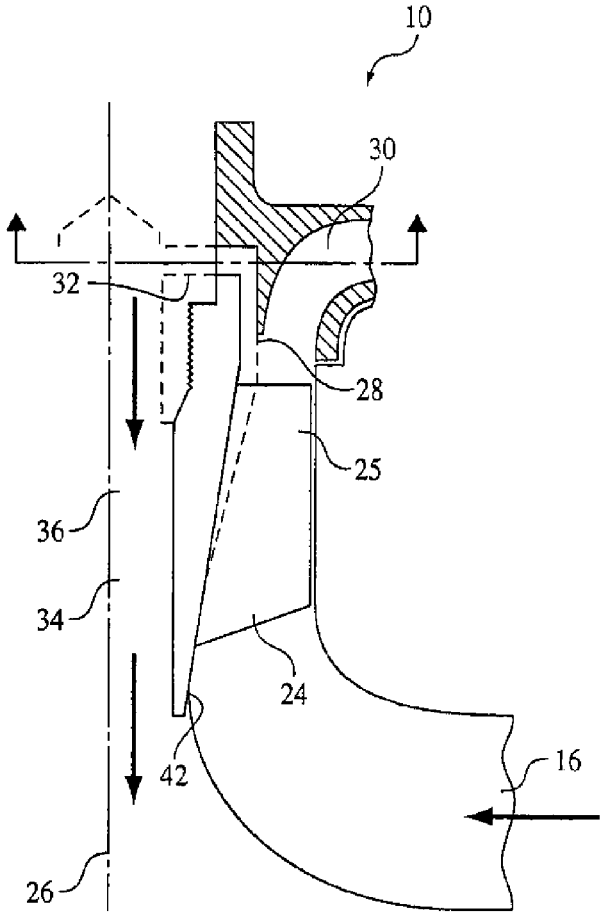

The separated gas travels through a flow path that returns it to the subsea separator 40 (FIG. 2). As shown in FIGS. 3A and 3B, the flow path includes radial holes 32 through the shaft 34 that connect with an axial hole 36 in the hollow shaft 34. This axial hole 36 is then connected to a return line 38 that returns to the subsea separator 40. This flow path can have a variety of geometries, including varying shape and orientation of the radial holes, features such as vanes in the axial hole 36, or a different direction (up through the shaft) altogether.

The separated gas traveling through the axial hole 36 is isolated from the inlet flow by a rotordynamic seal 42 between the casing and the hollow shaft 34 while permitting relative rotation between the rotating pump shaft and the stationary casing. The interface between the shaft 34 and the casing can have a variety of configurations, depending on axial or radial inlet flow The separated stream gas requires a pressure boost to be returned to the subsea separator 40. This can be achieved effectively and simply with, for example, an eductor pump 41 located in the separated stream piping between the casing and the separator. High pressure liquid is drawn off from the multiphase pump discharge (or some intermediate stage) through eductor flow control valve 43 and a suction gas return line 38 to provide the driving force in the eductor pump 41.

Recirculation of this driving liquid and the separated gas results in reduced volumetric efficiency of the multiphase pump 10. The suction gas return line 38 may be provided between a production control line 44 and the separator 40. An eductor flow control valve 43 can be placed in the suction gas return line 38 to throttle the flow rate drawn off of the pump 10 and returned to the separator 40 through suction gas return line 38, improving volumetric efficiency of the pump 10. This is possible as the process separator improves in efficiency after a well startup transient, reducing the gas carry-under to the pump 10, which reduces the separated gas flow rate and the recirculated liquid to the eductor pump 41. Flow that has not been bypassed continues through production control line 44 having liquid level control valve 48. Multi-phase fluid is carried from the separator 40 to the pump inlet through pump suction line 50. As known in the art, a bypass line 45 including a bypass valve 46 may be provided.

The gas separation system described, including the control valve and eductor as the throttling and motive forces, are the preferred embodiment of the gas separation approach. Other methods can be envisioned and implemented as part of the intent of this concept.

A subsea multistage centrifugal pump in this embodiment has the motor oriented above the pump with the pump suction facing down (FIG. 1). The motor rotor and the pump are mounted on independent shafts with separate bearing systems, and connected by a shaft coupling.

The orientation with pump suction facing down is necessary to achieve an acceptable NPSH (Net Positive Suction Head) when installed in an arrangement with a separator. The separator has to be elevated relative to the pump/motor to provide adequate NPSH for the pump.

An economical and reliable arrangement for a set of multistage hydraulics consists of a multitude of centrifugal stages stacked axially in series, with the gas-separating hydraulic stage in the same axial stack at the pump inlet. The hydraulics nested with the suctions all pointing in the same direction lends itself to a compact arrangement.

The motor is a hermetically sealed canned motor design. The thin metallic cans separate the motor rotor bars and motor stator windings and insulation from the process fluid, enabling reliable, long life motor operation. The process fluid is used to cool the motor, extracting heat generated in the motor across the metal cans. The cans allow the pump/motor to operate without the need for dynamic shaft seals or a buffer fluid and its required support systems. While the illustrated system utilizes a canned motor, the system may also be used with non-canned motors.

The separate motor and pump shafts are mounted on independent fluid film bearing systems. The bearings are lubricated with the process fluid, eliminating the need for a bearing lubrication fluid and its required support systems.

The hydraulic arrangement results in thrust loads all combining and directed toward the suction. To make a compact and economical thrust bearing, part of the hydraulically induced thrust load is balanced by a piston located on the pump shaft at the pump discharge. This piston and a close tolerance sleeve allow the pumped fluid to leak back to a lower pressure in a separate cavity, partially balancing the hydraulic load accumulated over each stage. This design arrangement is well know to practitioners schooled in the art. Typically the balance leakage fluid is vented by an appropriate conduit to the pump suction as a bypass flow.

Subsea process separator systems are not entirely effective at removing all solid particles from the multiphase flow. Abrasive particles of up to 50 microns in size must be handled by the subsea pump. The fluid film bearings in the subsea pump/motor assembly are made of ceramic materials, such as silicon carbide or tungsten carbide that have proven effective at withstanding abrasive particles. The bearings are designed to have a large fluid film for better particle handling characteristics.

Because the liquid filled motor is above the balance drum, any gas that is liberated across this throttling device tends to rise into the motor cavities. This gas accumulation could eventually result in partially uncovered upper bearings, which could lead to bearing damage and failure.

The pump motor in this embodiment incorporates a vent in the motor top cap which allows the balance flow to purge out of the top of the motor back to the separator. This serves to establish the pressure gradient required across the pump for thrust balance and to sweep free gas continuously out of the motor and back to the separator. While this permits some gas flow through the bearings it does not materially affect the fluid properties. This strategy requires that the top of the upper motor bearings be below the separator liquid level when the pump is shut down so that the process fluid does not flow back to the separator, uncovering the bearings.

In addition to providing the motive power for transporting the liquid phase from the separator to an appropriate surface facility, the pump is part of the separator liquid level control system. The pump speed can be varied to affect level control within the separator, or in the case of a centrifugal pump, the pump discharge can be throttled by liquid level control valve 48 to affect the same result; higher throttling results in a lower production flow rate while lower throttling passes a higher production flow rate. The ability to control the flow is required by variations in the output of the host well(s) and the need to handle transients during start-up and shutdown.

The gas-separating multiphase pump as described in this disclosure will operate with consistent performance regardless of pump suction pressure or variation in gas carry-under from the process separator. This enables the pump to provide stable performance across the life of the well as the wellhead pressure drops.

Nothing in the above description is meant to limit the invention to any specific materials, geometry, or orientation of elements. Many parts/orientation substitutions are contemplated within the scope of the invention and will be apparent to those skilled in the art. The embodiments described herein were presented by way of example only and should not be used to limit the scope of the invention. For example, the embodiment shown and described is a subsea separator system with oil/gas as the fluids. The invention, however, is not limited to such systems and could also be applied to other multiphase systems such as boiler feedwater de-aeration systems.

Although the invention has been described in terms of particular embodiments in an application, one of ordinary skill in the art, in light of the teachings herein, can generate additional embodiments and modifications without departing from the spirit of, or exceeding the scope of, the claimed invention. Accordingly, it is understood that the drawings and the descriptions herein are proffered only to facilitate comprehension of the invention and should not be construed to limit the scope thereof.

What is claimed is:

1. A multiphase pump separation system for separating multiphase process fluids, the system comprising:

a pump comprising:

a rotatable shaft having an axial hole;

at least one impeller mounted on the shaft and having an axis of rotation;

a motor engaged with the shaft for turning the at least one impeller;

at least one bearing for supporting the shaft;

a pump inlet for accepting incoming multiphase flow;

at least one inducer blade rotatable about the axis of rotation, wherein the inducer blade is disposed between the pump inlet and the at least one impeller;

an annular region including a portion having an inner diameter defined by a rotating surface on the rotatable shaft and an outer diameter defined by a rotating interior surface of the at least one impeller for separating gas from liquid in the multiphase flow;

at least one radial hole in the shaft operatively connecting the annular region and the axial hole of the shaft for directing separated gas to the axial hole; and a pump outlet for discharging liquid from the pump;

a fluid separator fluidly connected to the pump;

a gas return line in operable connection between the separator and the axial hole of the pump shaft for returning separated gas to the separator;

a pump inlet line in operable connection between the separator and the pump inlet for supplying multiphase fluid to the pump; and a pump outlet line for directing discharged liquid away from the pump.

2. The system according to claim 1, wherein the annular region includes at least one of a hole, a slot and a vane.

3. The system according to claim 1, wherein the annular region is sized such that the separated gas flow path area is the same ratio of the fluid path area as the pumped multiphase fluid gas volume fraction.

4. The system according to claim 1, further comprising a second pump for effecting gas flow in the gas return line.

5. The system according to claim 4, wherein the second pump is an eductor pump.

6. The system according to claim 1, wherein the motor is a canned motor pump having a stator and a rotor hermetically sealed from the process fluids by metallic cans.

7. The system according to claim 1, wherein the at least one bearing is at least one fluid film bearing lubricated by the process fluid.

8. The system according to claim 1, wherein the system is a gas/oil subsea separator system.

9. The system according to claim 1, wherein the motor includes a vent configured to return gas from the motor to the fluid separator.

* * * * *